US009653769B2

(12) United States Patent
Shimizu et al.

(10) Patent No.: US 9,653,769 B2
(45) Date of Patent: May 16, 2017

(54) CONNECTION STRUCTURE BETWEEN ANTENNA APPARATUS AND RADIO COMMUNICATION APPARATUS

(71) Applicant: NEC Corporation, Tokyo (JP)

(72) Inventors: Masatoshi Shimizu, Tokyo (JP); Naoyuki Orihashi, Tokyo (JP)

(73) Assignee: NEC Corporation, Tokyo (JP)

( * ) Notice: Subject to any disclaimer, the term of this patent is extended or adjusted under 35 U.S.C. 154(b) by 154 days.

(21) Appl. No.: 14/379,754

(22) PCT Filed: Jan. 18, 2013

(86) PCT No.: PCT/JP2013/050988

§ 371 (c)(1),
(2) Date: Aug. 20, 2014

(87) PCT Pub. No.: WO2013/125272

PCT Pub. Date: Aug. 29, 2013

(65) Prior Publication Data

US 2016/0028141 A1 Jan. 28, 2016

(30) Foreign Application Priority Data

Feb. 21, 2012 (JP) ..... 2012-035118

(51) Int. Cl.
*H01Q 13/00* (2006.01)
*H01P 3/12* (2006.01)
(Continued)

(52) U.S. Cl.
CPC ..... *H01P 3/12* (2013.01); *H01P 1/042* (2013.01); *H01Q 1/22* (2013.01); *H01Q 1/24* (2013.01);
(Continued)

(58) Field of Classification Search
CPC ..... H01Q 13/20; H01Q 13/06; H01Q 13/28; H01Q 13/10; H01Q 1/38
(Continued)

(56) References Cited

U.S. PATENT DOCUMENTS 3,483,564 A 12/1969 Glynn
4,879,534 A 11/1989 Spinner
(Continued)

FOREIGN PATENT DOCUMENTS

CN 101031781 A 9/2007
CN 201503897 U 6/2010
(Continued)

OTHER PUBLICATIONS

Office Action issued by the Chinese Patent Office in counterpart Chinese Patent Application No. 201380010360.3, dated Jun. 4, 2015.
(Continued)

*Primary Examiner* — Graham Smith
*Assistant Examiner* — Collin Dawkins
(74) *Attorney, Agent, or Firm* — Finnegan, Henderson, Farabow, Garrett & Dunner, L.L.P.

(57) ABSTRACT

Antenna 2 and radio communication apparatus 1 include mount portions 9 and 15, flat proximity opposing surfaces 13 and 20, and waveguide portions 12 and 19 penetrating through proximity opposing surfaces 13 and 20, respectively. For example, in proximity opposing surface 13 of radio communication apparatus 1, choke groove 14 is formed outside waveguide portion 12. With mount portions 9 and 15 of antenna 2 and radio communication apparatus 1 abutted against and fixed to each other, proximity opposing surfaces 13 and 20 are set parallel to, and directly opposite to each other with a clearance interposed therebetween so
(Continued)

that waveguide portions 12 and 19, opposite to each other and with a clearance, form a waveguide.

19 Claims, 4 Drawing Sheets

(51) Int. Cl.
*H01P 1/04* (2006.01)
*H01Q 1/22* (2006.01)
*H01Q 19/13* (2006.01)
*H01Q 1/24* (2006.01)
*H01Q 19/10* (2006.01)

(52) U.S. Cl.
CPC ..... *H01Q 13/00* (2013.01); *H01Q 19/10* (2013.01); *H01Q 19/134* (2013.01)

(58) Field of Classification Search
USPC ..... 343/772, 762, 767, 786
See application file for complete search history.

(56) References Cited

U.S. PATENT DOCUMENTS

| | | | | |
|---|---|---|---|---|
| 2006/0071848 | A1 | 4/2006 | Edvardsson | |
| 2008/0001686 | A1* | 1/2008 | Chao | H01P 1/042 333/254 |
| 2011/0074652 | A1* | 3/2011 | Lewry | H01Q 1/125 343/882 |

FOREIGN PATENT DOCUMENTS

| | | | |
|---|---|---|---|
| CN | 102110868 | A | 6/2011 |
| CN | 202067885 | U | 12/2011 |
| EP | 0 478 894 | A1 | 4/1992 |
| JP | 04-123610 | | 11/1992 |
| JP | 2001-156501 | | 6/2001 |
| JP | 2003-188601 | | 7/2003 |
| JP | 2004-048418 | | 2/2004 |
| JP | 2008-25785 | | 2/2008 |
| JP | 2009-218794 | | 9/2009 |
| JP | 2011-151447 | | 8/2011 |
| WO | WO 2006/038861 | A1 | 4/2006 |

OTHER PUBLICATIONS

Office Action issued by the Chinese Patent Office in counterpart Chinese Patent Application No. 201380010360.3, dated Jan. 18, 2016.

International Search Report for PCT/JP2013/050988 mailed Apr. 16, 2013.

Extended European Search Report mailed Oct. 1, 2015 by the European Patent Office in counterpart European Patent Application No. 13751128.3.

* cited by examiner

CONNECTION STRUCTURE BETWEEN ANTENNA APPARATUS AND RADIO COMMUNICATION APPARATUS

CROSS-REFERENCE TO RELATED PATENT APPLICATIONS

This application is a National Stage Entry of International Application No. PCT/JP2013/050988, filed Jan. 18, 2013, which claims priority from Japanese Patent Application No. 2012-035118, filed Feb. 21, 2012. The entire contents of the above-referenced applications are expressly incorporated herein by reference.

TECHNICAL FIELD

The present invention relates to a connection structure between an antenna apparatus and a radio communication apparatus.

BACKGROUND ART

In the mobile communication system such as a mobile phone system, access networks for connecting radio base stations are constructed. The access network using radio communication by means of microwaves has the advantage of low network construction costs and flexibility in terms of where radio base stations can be installed. The radio communication equipment for constructing an access network of this kind includes: an antenna apparatus installed at an obstacle-free, high elevation place such as a steel tower, the roof of a building; a radio communication apparatus installed close to the antenna apparatus; and an indoor apparatus that is separated from these and installed indoors to perform modulation and demodulation processing of transmission signals.

The antenna apparatus and the radio communication apparatus send and receive high-frequency signals via a waveguide. Specifically, a waveguide portion provided for the antenna apparatus and a waveguide portion provided for the housing of the radio communication apparatus are aligned opposite to each other and are closely joined to form a waveguide, through which high-frequency signals propagate. However, if there is a gap between the waveguide portion of the antenna apparatus and the waveguide portion in the housing of the radio communication apparatus, high-frequency signals leak out of the waveguide from the gap, resulting in signal loss when high frequency signals are propagated.

To deal with this, in the configuration described in Patent Document 1, a slidable shim is disposed at the joint between the waveguide portion of the antenna apparatus and the waveguide portion in the housing of the radio communication apparatus. Thus, the waveguide portion of the antenna apparatus and the waveguide portion in the housing of the radio communication apparatus are connected by the shim so as to construct a waveguide without a gap.

BACKGROUND ART DOCUMENTS

Patent Documents

Patent Document 1: JP2001-156501A

Patent Document 2: JP2003-188601A

SUMMARY OF THE INVENTION

Problems to be Solved by the Invention

The configuration disclosed in Patent Document 1 needs a large number of parts and has a complicated structure. Since it is impossible to make the inside diameters of the components of the waveguide, i.e., the waveguide portion of the antenna apparatus and the waveguide portion in the housing of the radio communication apparatus, completely coincide with the inside diameter of the shim, the diameter of the waveguide varies halfway at places. This exerts an adverse effect on the signal propagation characteristics through the waveguide.

When the waveguide portion of the antenna apparatus and the waveguide portion of the housing of the radio communication apparatus abut each other without using a shim as in Patent Document 1, a partial gap due to unsymmetrical contact appears between the end faces of the two waveguide portions, posing the problem of signal loss due to signal leakage. To deal with this, there is an idea that a choke groove is provided in the end faces (abutment surfaces) of two waveguide portions to anticipate a case where a gap appears between the two end faces. However, since this configuration is based on the assumption that the abutment surfaces of the waveguide portions abut against each other, a part of the abutment surface first comes in partial contact with each other, tending to cause unsymmetrical contact and inclination, and therefore the problem still persists in which a gap is formed whose size varies depending on the position in the circumferential direction. That is, there is the possibility that a gap will be present partway across the waveguide and the size of the gap will not be uniform. As a result, the size of the choke groove formed on the abutment surface cannot be appropriately adjusted to fit the gap. Further, in order to make the abutment surfaces of two waveguide portions abut without any gap as in Patent Document 2, it is necessary to fix the precision parts or the waveguide portions by applying pressure to each of the waveguide portions, which may cause deformation or damage to the resultant waveguide made of the waveguide portions. Moreover, the pressure may cause adverse influence on the surrounding components of the waveguide portions, causing a warp and deformation of the housing of the radio communication apparatus to occur, which may further cause an adverse effect on the circuit board supported by the housing and electronic parts mounted on the circuit board.

The object of the present invention is to solve the above problems and provide a connection structure between an antenna apparatus and a radio communication apparatus, which has a simple configuration and which can prevent an adverse effect due to the pressure applied on a waveguide and can efficiently prevent leakage of the signal from a gap in the waveguide.

Means for Solving the Problems

A connection structure between an antenna apparatus and a radio communication apparatus of the present invention includes: proximity opposing surfaces and waveguide portions penetrating the proximity opposing surfaces, each provided for the antenna apparatus and the radio communication apparatus; a choke groove formed outside the waveguide portion in either or both of the proximity opposing surfaces of the antenna apparatus and the radio communication apparatus, and a waveguide formed of the waveguide portions opposite to each other with a clearance therebetween in a state in which the antenna apparatus and the radio communication apparatus are fixed to each other and the proximity opposing surfaces are directly opposite to each other with the clearance therebetween and placed in parallel to each other.

The connection structure may further include: mount portions provided for the antenna apparatus and the radio communication apparatus, wherein when the antenna apparatus and the radio communication apparatus are fixed to each other, the mount portions abut and are fixed to each other.

It is preferable that the proximity opposing surfaces are flat.

Effect of the Invention

According to the present invention, it is possible with a simple configuration to prevent adverse effects due to the pressure applied to the waveguide and efficiently prevent leakage of the signal from a gap in the waveguide. It is also possible to obtain high reliability in the propagation characteristics in the waveguide.

EXEMPLARY EMBODIMENT

Next, a connection structure between an antenna apparatus and a radio communication apparatus of an exemplary embodiment of the present invention will be described.

Figure 1:
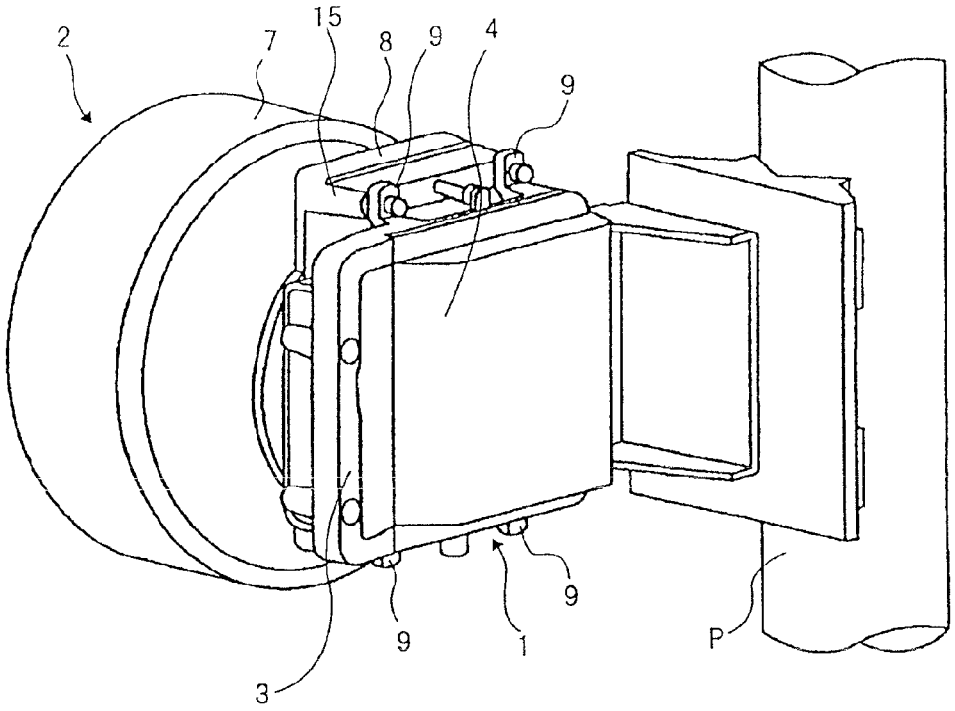
FIG. 1 is a perspective view showing a state of use of an antenna apparatus and a radio communication apparatus.
Figure 2:
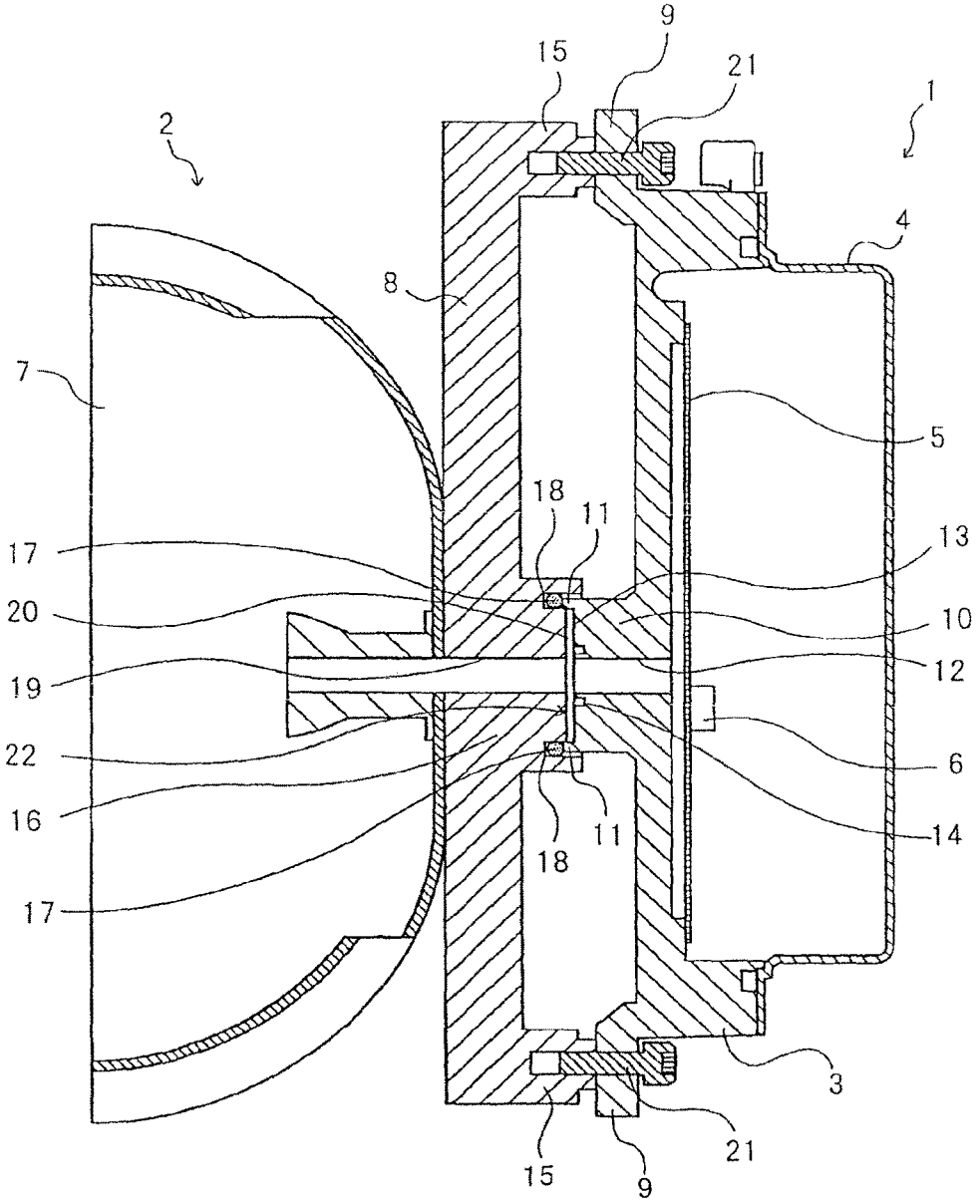
FIG. 2 is a sectional view showing a connection structure between an antenna apparatus and a radio communication apparatus according to one exemplary embodiment of the present invention.
Figure 3:
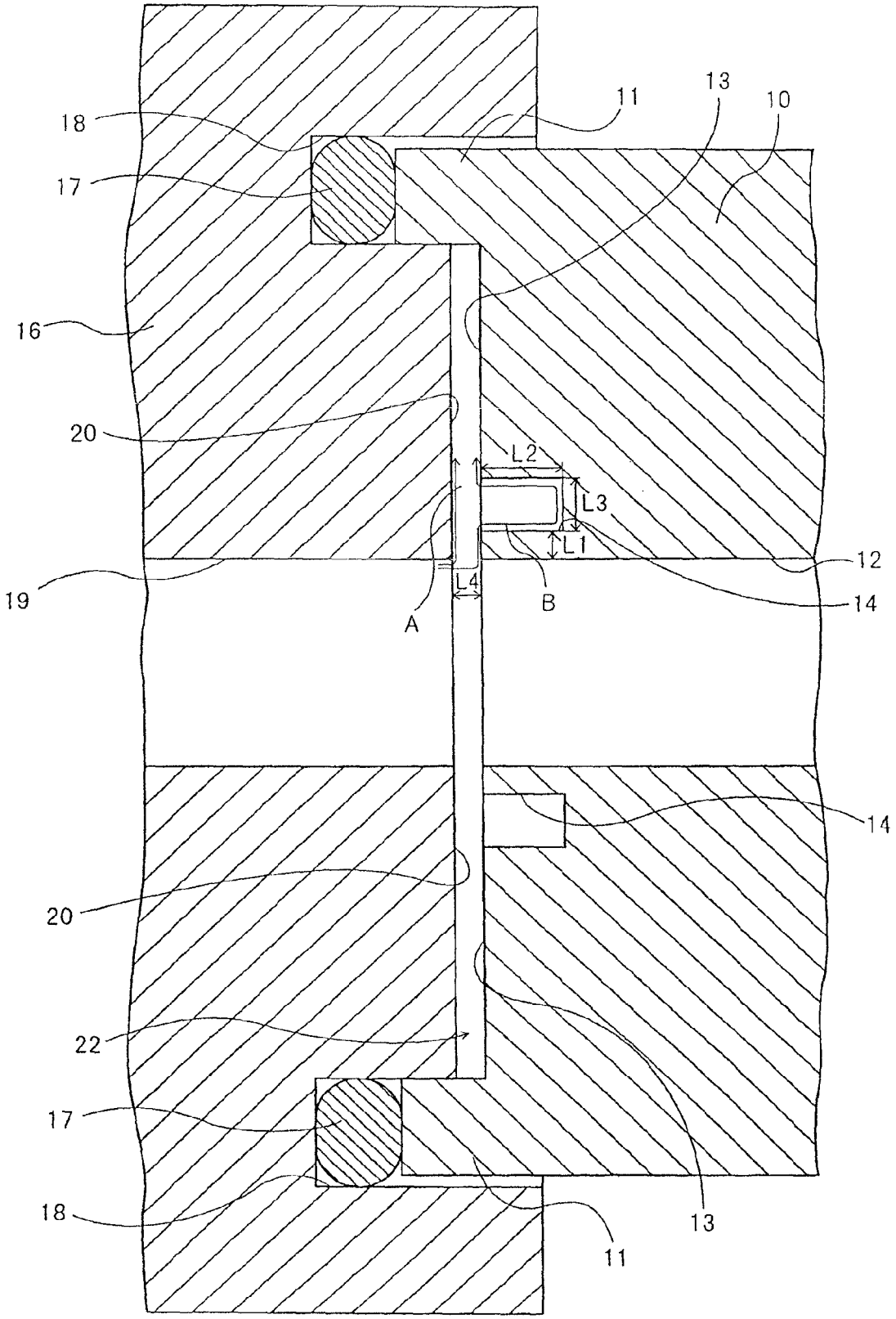
FIG. 3 is a partial enlarged view of FIG. 2.

As shown in FIG. 1, in the present exemplary embodiment, a radio communication apparatus (also called ODU: Out Door Unit) 1 is attached to pole P located outdoors while an antenna apparatus is fixed to radio communication apparatus 1. The present exemplary embodiment will be described hereinbelow by giving a configurational example in which the antenna apparatus includes single antenna 2. However, the number of antennas is not limited to one. In radio communication apparatus 1, a robust hollow container is formed by housing 3 and cover 4 which are joined to each other. As shown in FIGS. 2 and 3, radio communication apparatus 1 accommodates, inside the hollow container made of housing 3 and cover 4, electronic circuits such as a transmitter circuit, a receiver circuit, and the like, formed of circuit board 5 such as a flexible printed board, electric parts 6 mounted on circuit board 5, and the like. Antenna 2 is a so-called parabola antenna, which includes reflector unit 7 and base unit 8 supporting reflector unit 7 and which is joined to housing 3 of radio communication apparatus 1.

Housing 3 of radio communication apparatus 1 has a plurality of (four, in the example shown in FIG. 1) flange-like mount portions (fixing portions) 9 in its outer periphery. Provided in the inner periphery of housing 3 is a columnar portion 10 projected toward base unit 8 of antenna 2 to be joined. This columnar portion 10 is formed with annular fitting rib 11 located along the outer circumference of columnar portion 10, waveguide portion (first waveguide) 12 that is located at the center of columnar portion 10 and that penetrates through housing 3, proximity opposing surface 13 as the end face of waveguide portion 12, and choke groove 14 formed around the opening in proximity opposing surface 13.

Since waveguide portion 12 is integrally formed in housing 3 of radio communication apparatus 1, this exemplary embodiment is simplified in structure and is produced by an easier manufacturing process compared to the configuration where a waveguide is produced separately from housing 3 and attached to the housing by use of connection parts. Further, since housing 3 including waveguide portion 12 is formed by casting metal (e.g., aluminum alloy), resistance to adverse weather as well as the advantage of low cost manufacturing can be obtained.

Arranged in the outer periphery of base unit 8 of antenna 2 are mount portions (fixing portions) 15 opposite to mount portion 9 of housing 3. In the inner periphery of base unit 8, columnar portion 16 that is projected toward housing 3 to be joined and that has a greater diameter than that of columnar portion 10 of housing 3 is formed. This columnar portion 16 is formed with annular fitting groove 18 that holds waterproof packing 17 and into which fitting rib 11 of columnar portion 10 is inserted, waveguide portion (second waveguide) 19 that is located in the center of columnar portion 16 and that passes through base unit 8, and proximity opposing surface 20 as the end face of waveguide portion 19.

In this configuration, when the size of mount portions 9 and 15 and the size of columnar portions 10 and 16 are set appropriately so that mount portion 9 of housing 3 of radio communication apparatus 1 and mount portion 15 of base unit 8 of antenna 2 abut each other, proximity opposing surface 13 of columnar portion 10 and proximity opposing surface 20 of columnar portion 16 are kept in parallel and positioned apart from each other with clearance 22 if no external force is applied. At this time, fitting rib 11 is inserted into fitting groove 18 and its end abuts waterproof packing 17 to seal off proximity opposing surfaces 13 and 20 from the surroundings. In this condition, mount portions 9 and 15 are fixed to each other by the fastener, i.e., bolt 21 so as to form a waveguide of waveguide portions 12 and 19 that are opposite to each other and to complete the connection structure between antenna 2 and radio communication apparatus 1. The technical meaning of this configuration will be described next.

In the present exemplary embodiment, the end faces of waveguide portions 12 and 19 are not abutting surfaces which are assumed to come into contact with each other like those of Patent Document 1, but are arranged to form proximity opposing surfaces 13 and 20 that do not abut each other. Proximity opposing surfaces 13 and 20 are arranged without contact with each other, or are apart from each other with clearance 22 of, for example, about 0.2 to 0.8 mm, so as to be directly opposite to each other with no other component interposed therebetween.

In a case where abutment surfaces are formed as in Patent Document 1, it is presumed that the abutment surfaces come into contact with each other. Accordingly, the abutment surfaces are brought closer until they abut each other. In this case, if the surface roughness or flatness is low, a state of partial contact will occur in which part of the two abutment surfaces will make contact with each other whereas other parts of the two abutment surfaces will remain apart. As a result, the abutment surfaces are set non-parallel or are set to be inclined with each other. In contrast, the present exemplary embodiment is constructed so that proximity opposing surfaces 13 and 20 are not intended to abut each other, or is constructed on the assumption that proximity opposing surfaces 13 and 20 are intended not to be so close to each other and therefore they do not contact with each other. Since proximity opposing surfaces 13 and 20 will not abut each other, it is possible to keep a parallel positional relationship between proximity opposing surfaces 13 and 20. Though there is partial unevenness on proximity opposing surfaces 13 and 20 when the surface roughness or flatness is low, it is easy for the surfaces to kept mostly parallel to each other.

In this configuration, clearance 22 is formed halfway through the waveguide made of waveguide portions 12 and 19. Further, in order to prevent leakage of the high-frequency signal propagating through the waveguide from clearance 22, choke groove 14 is formed in proximity opposing surface 13. That is, choke groove 14, for preventing the high-frequency signal that passes through the two waveguide portions (the first waveguide and second waveguide) 12 and 19 from leaking out, is formed on the outer circumference of the opening of proximity opposing surface 13. As shown in FIG. 3, part of the high-frequency signal propagating through the waveguide travels toward the outside from clearance 22. Then, part of the high-frequency signal that propagates from clearance 22 to the outside first enters choke groove 14 and then returns to clearance again. At this time, high-frequency signal B, that has first entered choke groove 14 and then returns to clearance 22 again, travels longer than high-frequency signal A, that directly propagates through clearance 22 without entering choke groove 14, so that the former is out of phase with the latter by the differential distance. If high-frequency signal B that has first entered choke groove 14 and then returns to clearance 22 again is opposite in phase to high-frequency signal A that directly propagates through clearance 22 without entering choke groove 14, the two signals cancel out each other so as to produce a state where no high-frequency signal propagating toward the outside is present in clearance 22. In a word, a state with zero leakage of high-frequency signals to clearance 22 is attained.

To prevent leakage of the high-frequency signal to clearance 22 by providing choke groove 14 in the above way requires the travel path of high-frequency signal B to be set at a suitable length. The travel path of high-frequency signal B is determined depending on distance L1 between waveguide portion 12 and choke groove 14 (the distance from the interior edge of waveguide portion 12 to choke groove 14), depth L2 of choke groove 14 (the distance in the direction perpendicular to proximity opposing surface 13 or the thickness direction of columnar portion 10), width L3 of choke groove 14 in the direction toward waveguide portion 12 (the width in the circumferential direction of columnar portion 10) and size L4 of clearance 22. That is, when distances L1, L2, L3, and L4 are properly designated, leakage of the high-frequency signal to clearance 22 can be prevented.

Suppose that the end faces of waveguide portions 12 and 19 are not parallel to each other so that clearance 22 is not uniform but varies, then size L4 of clearance 22 will not be constant. As a result, high-frequency signal B that first enters choke groove 14 and then returns to clearance 22 again could not become perfectly opposite in phase to high-frequency signal A that directly propagates through clearance 22 without entering choke groove 14, so that there is a risk that leakage of the high-frequency signal cannot be sufficiently prevented. However, since, in the present exemplary embodiment, proximity opposing surfaces 13 and 20 do not abut each other and therefore clearance 22 remains, proximity opposing surfaces 13 and 20 are kept in parallel to each other so as to produce clearance 22 of a desired size. As a result, it is possible to prevent leakage of the high-frequency signal due to the effect that is obtained by forming choke groove 14 despite the presence of clearance 22.

In particular, when, for wavelength $\lambda$ of the high-frequency signal that propagates through the waveguide, distance L1 is $\lambda/4$ and distance L2 is $\lambda/4$, then leakage of the high-frequency signal to clearance 22 can be efficiently prevented.

When housing 3 is produced by metal casting in order to achieve strong adverse weather resistance characteristics as well as the advantage of low cost manufacturing, it is preferred that $L2 \leq 3 \times L3$ be satisfied in order to secure high reliability in the production process. In particular, if $L2=3 \times L3$ is satisfied, it is possible to easily form choke groove 14 and efficiently prevent the high-frequency signal from leaking.

The present exemplary embodiment is preliminarily designed so that proximity opposing surfaces 13 and 20 will not come into contact with each other when mount portions 9 and 15 abut each other. That is, waveguide portions 12 and 19 are intentionally designed to be short. In this way, proximity opposing surfaces 13 and 20 do not come into contact with each other, so that housing 3 will not deform even if force is applied to columnar portion 10, and there is no need for concern that waveguide portions 12 and 19, circuit board 5 and electric parts 6 will be damaged.

Choke groove 14 of the present exemplary embodiment may be formed along the whole outer circumference of waveguide portion 12. However, choke groove 14 may also be formed along only part of the outer circumference of waveguide portion 12. For example, when the cross section of waveguide 12 is a rectangular, it is possible to form a linear choke groove at the position opposite to each of the two long sides of the rectangular section of waveguide portion 12 with no choke groove formed on the positions opposite to the two short sides of the rectangular section of waveguide portion 12.

When choke groove 14 is provided in proximity opposing surface 20 of antenna 2 instead of proximity opposing surface 13 of radio communication apparatus 1, it is also possible to obtain the effect of preventing leakage of the high-frequency signal to clearance 22. Further, when choke grooves 14 are provided on both proximity opposing surface 13 of radio communication apparatus 1 and proximity opposing surface 20 of antenna 2, reliable prevention of high-frequency signal leakage can be improved in addition to obtaining the same effect as described above.

Figure 4A:
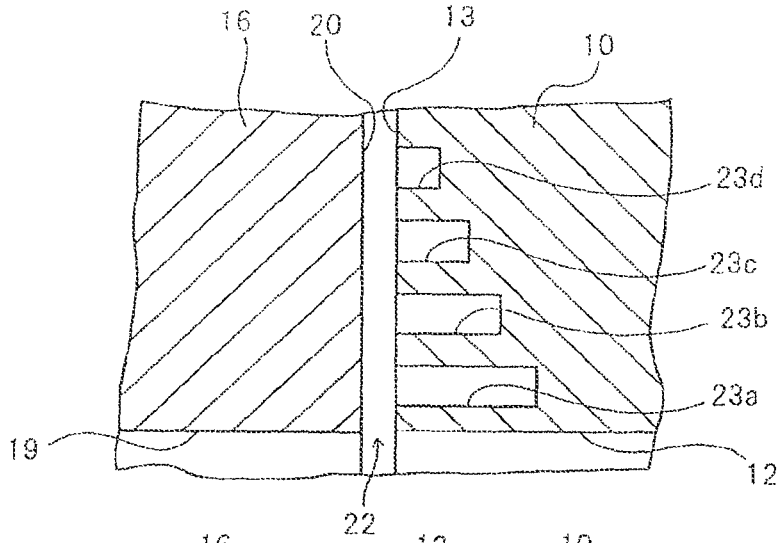
FIGS. 4*a*-4*c* are partial enlarged views showing other examples of choke grooves.
Figure 4B:
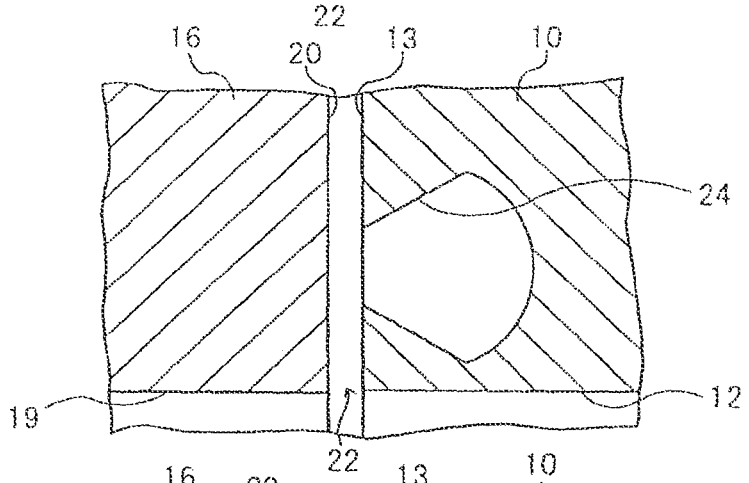
Figure 4C:
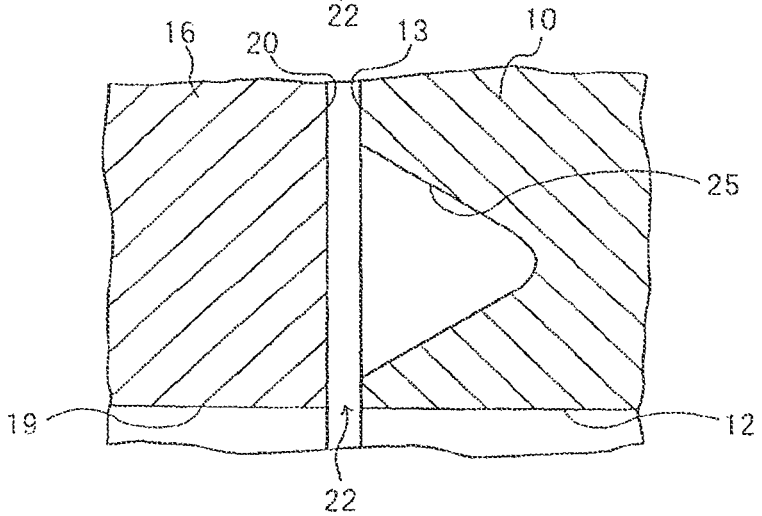

FIGS. 4*a* to 4*c* show another example of choke grooves of the present invention. In the example shown in FIG. 4*a*, a plurality of choke grooves 23*a*, 23*b*, 23*c*, and 23*d* of different sizes are formed in proximity opposing surface 13. In the example shown in FIG. 4*b*, sector-shaped choke groove 24 is formed in proximity opposing surface 13. In the example shown in FIG. 4*c*, approximately triangular choke groove 25 is formed in proximity opposing surface 13. Since the configuration shown in FIG. 4*a* has a plurality of choke grooves 23*a* to 23*d* each having different distance L2 from the others, it is possible to obtain the effect in which leakage of a plurality of high-frequency signals having different wavelengths to clearance 22 is prevented. Since, in the configurations shown in FIG. 4*b* and FIG. 4*c*, distance L2 varies continuously in a single choke groove 24 or 25, these configurations make it possible to broaden the frequency range of signal which can be prevented from leaking, or these configurations can prevent leakage of the signal, despite frequency fluctuations (continuous variation) over a wide range.

According to the present invention, the end faces (proximity opposing surfaces) of two waveguide portions forming a waveguide are intentionally designed not to abut each other to thereby eliminate the possibility that the two end faces will come into contact with each other in some parts but will come apart from each other in other parts. That is, the end faces will not partially abut each other, so that it is easy to keep the end faces parallel to each other without causing inclination and make the size of the clearance constant along the circumference. As a result, it is possible to easily create a choke groove of a size suitable to the clearance at an intermediary position of the waveguide, and hence to efficiently prevent signal leakage, thus achieving high reliability in the propagation characteristics of the waveguide. Further, since the two surfaces are configured not to abut each other, there is no risk that the hollow portion, as well as other various components, will be damaged when pressure is applied to the waveguide portions. Moreover, since it is not necessary to shape the proximity opposing surfaces with very high precision, this configuration can be easily produced at a low production cost.

The exemplary embodiments described above relate to the connection structure for connecting an antenna apparatus of single antenna 2 with single radio communication apparatus 1. However, the present invention can be applied to a connection structure for connecting antennas and a directional coupler (hybrid) with a radio communication apparatus. In this way, the present invention should not be limited to the above exemplary embodiments. Various combinations, variations, and modifications of the disclosed contents in the exemplary embodiments should be included in the present invention.

This application claims priority based on Japanese Patent Application No. 2012-035118, filed on Feb. 21, 2012, and should incorporate all the disclosure thereof in Japanese Patent Application No. 2012-035118.

DESCRIPTION OF REFERENCE NUMERALS

1 radio communication apparatus (ODU)
2 antenna
3 housing
4 cover
5 circuit board
6 electric part
7 reflector unit
8 base unit
9, 15 mount portion (fixing portion)
10, 16 columnar portion
11 fitting rib
12, 19 waveguide portion
13, 20 proximity opposing surface
14, 23*a*, 23*b*, 23*c*, 23*d*, 24, 25 choke groove
17 waterproof packing
18 fitting groove

What is claimed is:

1. A radio communication system, comprising:

a radio communication apparatus including a first waveguide;

an antenna apparatus including a second waveguide;

a fastener that fixes the radio communication apparatus to the antenna apparatus by setting the first waveguide and the second waveguide to be opposite to each other, with the opposing end faces of the first waveguide and the second waveguide kept apart from without coming into contact with each other, while a mount portion of the radio communication apparatus and a mount portion of the antenna apparatus abut against each other;

a choke groove formed along the outer circumference of an opening in, at least, one of the opposing end faces of the first waveguide and the second waveguide to prevent the high-frequency signal that passes through the first waveguide and the second waveguide from leaking;

a fitting groove provided outside the opposing end face of one apparatus selected from the antenna apparatus and the radio communication apparatus;

a fitting rib to be inserted into the fitting groove, provided for the remaining antenna apparatus or the radio communication apparatus; and a seal for isolating the opposing end faces from the surroundings by inserting the fitting rib into the fitting groove with a waterproof packing interposed therein.

2. The radio communication system according to claim 1, wherein when the antenna apparatus and the radio communication apparatus are fixed to each other, the mount portions abut and are fixed to each other.

3. The radio communication system according to claim 1, wherein the opposing end faces are flat.

4. The radio communication system according to claim 1, wherein:

the antenna apparatus is a single antenna having a reflector unit and a base unit for supporting the reflector unit, the radio communication apparatus includes:

a housing joined to the base unit of the antenna;

a cover attached to the housing to form a hollow container;

a circuit board sealed inside the container formed by the housing and the cover; and electric parts mounted on the circuit board, and the opposing end face and the waveguide are arranged in each base unit of the antenna and are also arranged in the housing of the radio communication apparatus.

5. The radio communication system according to claim 1, wherein the antenna apparatus includes an antenna having a reflector unit and a base unit for supporting the reflector unit and a directional coupler to which the antenna is connected, the radio communication apparatus includes:

a housing to be joined to the directional coupler;

a cover to be attached to the housing to form a hollow container;

a circuit board sealed inside the container formed by the housing and the cover; and electric parts provided on the circuit board, and the opposing end face and the waveguide are arranged in each directional coupler and the housing of the radio communication apparatus.

6. The radio communication system according to claim 1, wherein the depth of the choke groove is equal to or smaller than three times the width of the choke groove in the direction toward the waveguide.

7. The radio communication system according to claim 1, wherein:

the depth of the choke groove is one-fourth of the wavelength of the signal propagating through the waveguide, and the distance between the choke groove and the waveguide is one-fourth of the wavelength of the signal.

8. A radio communication system, comprising:

a radio communication apparatus including a first waveguide;

an antenna apparatus including a second waveguide;

a fastener that fixes the radio communication apparatus to the antenna apparatus by setting the first waveguide and the second waveguide to be opposite to each other, with the opposing end faces of the first waveguide and the second waveguide kept apart from without coming into contact with each other, while a mount portion of the radio communication apparatus and a mount portion of the antenna apparatus abut against each other; and a choke groove formed along the outer circumference of an opening in, at least, one of the opposing end faces of the first waveguide and the second waveguide to prevent the high-frequency signal that passes through the first waveguide and the second waveguide from leaking, wherein:

the antenna apparatus is a single antenna having a reflector unit and a base unit for supporting the reflector unit, the radio communication apparatus includes:

a housing joined to the base unit of the antenna;

a cover attached to the housing to form a hollow container;

a circuit board sealed inside the container formed by the housing and the cover; and electric parts mounted on the circuit board, and the opposing end face and the waveguide are arranged in each base unit of the antenna and are also arranged in the housing of the radio communication apparatus.

9. The radio communication system according to claim 8, wherein when the antenna apparatus and the radio communication apparatus are fixed to each other, the mount portions abut and are fixed to each other.

10. The radio communication system according to claim 8, wherein the opposing end faces are flat.

11. The radio communication system according to claim 8, wherein the housing of the radio communication apparatus is formed by casing metal.

12. The radio communication system according to claim 8, wherein the depth of the choke groove is equal to or smaller than three times the width of the choke groove in the direction toward the waveguide.

13. The radio communication system according to claim 8, wherein:

the depth of the choke groove is one-fourth of the wavelength of the signal propagating through the waveguide, and the distance between the choke groove and the waveguide is one-fourth of the wavelength of the signal.

14. A radio communication system, comprising:

a radio communication apparatus including a first waveguide;

an antenna apparatus including a second waveguide;

a fastener that fixes the radio communication apparatus to the antenna apparatus by setting the first waveguide and the second waveguide to be opposite to each other, with the opposing end faces of the first waveguide and the second waveguide kept apart from without coming into contact with each other, while a mount portion of the radio communication apparatus and a mount portion of the antenna apparatus abut against each other; and a choke groove formed along the outer circumference of an opening in, at least, one of the opposing end faces of the first waveguide and the second waveguide to prevent the high-frequency signal that passes through the first waveguide and the second waveguide from leaking, wherein:

the antenna apparatus includes an antenna having a reflector unit and a base unit for supporting the reflector unit and a directional coupler to which the antenna is connected, the radio communication apparatus includes:

a housing to be joined to the directional coupler;

a cover to be attached to the housing to form a hollow container;

a circuit board sealed inside the container formed by the housing and the cover; and electric parts provided on the circuit board, and the opposing end face and the waveguide are arranged in each directional coupler and the housing of the radio communication apparatus.

15. The radio communication system according to claim 14, wherein when the antenna apparatus and the radio communication apparatus are fixed to each other, the mount portions abut and are fixed to each other.

16. The radio communication system according to claim 14, wherein the opposing end faces are flat.

17. The radio communication system according to claim 14, wherein the housing of the radio communication apparatus is formed by casing metal.

18. The radio communication system according to claim 14, wherein the depth of the choke groove is equal to or smaller than three times the width of the choke groove in the direction toward the waveguide.

19. The radio communication system according to claim 14, wherein:

the depth of the choke groove is one-fourth of the wavelength of the signal propagating through the waveguide, and the distance between the choke groove and the waveguide is one -fourth of the wavelength of the signal.

* * * * *